United States Patent [19]

Lindahl et al.

[11] Patent Number: 4,537,656

[45] Date of Patent: Aug. 27, 1985

[54] METHOD FOR DELIGNIFYING OR BLEACHING CELLULOSE PULP WHEREIN CHLORINE IS ADDED TO RECYCLE LIQUOR TO REGENERATE CHLORINE DIOXIDE

[75] Inventors: Jonas A. I. Lindahl; John R. Bergstrom, both of Domsjo, Sweden

[73] Assignee: Mo och Domsjo Aktiebolag, Ornskoldsvik, Sweden

[21] Appl. No.: 557,385

[22] Filed: Dec. 1, 1983

Related U.S. Application Data

[63] Continuation of Ser. No. 323,323, Nov. 20, 1981, abandoned.

[30] Foreign Application Priority Data

Nov. 27, 1980 [SE] Sweden ..... 8008337

[51] Int. Cl.[3] ..... D21C 9/14

[52] U.S. Cl. ..... 162/38; 162/44; 162/45; 162/87; 162/88; 162/DIG. 8

[58] Field of Search ..... 423/477, 478; 162/66, 162/67, 88, 89, 37, 38, 40, 44, 45, 87, 18, 56, 39, DIG. 8, 62; 8/108 A, 156

[56] References Cited

PUBLICATIONS

Pattysun et al., "Bleaching in the Closed Cycle Mill at Great Lakes Forest Products, Ltd.", Pulp and Paper Canada, presented in June 1979 at Pulp and Bleaching Conference at Toronto.

Rapson et al., "Dynamic Bleaching: Continuous Movement of Pulp Through Liquor Increases Bleaching Rate", *TAPPI,* Aug. 1966, vol. 49, No. 8.

Gullichsen, "Pilot Plant Application of the Displacement Bleaching Process", *TAPPI,* Nov. 1973, vol. 56, Nov. 11.

*Primary Examiner*—Steve Alvo

[57] ABSTRACT

A method for delignifying and/or bleaching cellulose pulp adds to the cellulose pulp a liquid which contains chlorine dioxide, causes the pulp to react with the chlorine dioxide over a selected period of time, and then reduces the amount of available active chlorine, optionally to a negligible amount, either by reducing the amount of liquid accompanying the cellulose pulp and/or by displacing such liquid with a newly supplied liquid containing no active chlorine or at most only a small amount of active chlorine; the displaced liquor can be replenished with chlorine and optionally with chlorine dioxide, and then added mainly to fresh cellulose pulp in the same bleaching stage, and/or to cellulose pulp in another bleaching stage.

9 Claims, 1 Drawing Figure

Figure 1:
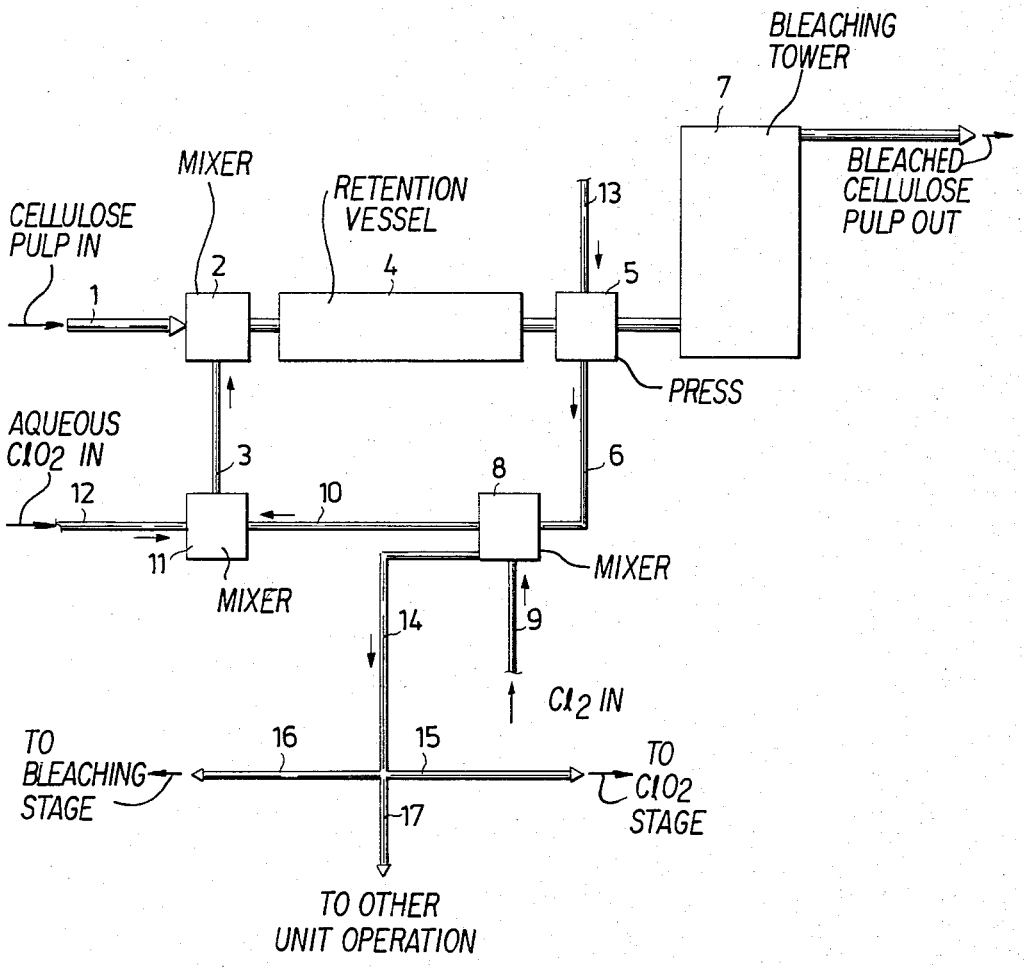

METHOD FOR DELIGNIFYING OR BLEACHING CELLULOSE PULP WHEREIN CHLORINE IS ADDED TO RECYCLE LIQUOR TO REGENERATE CHLORINE DIOXIDE

This is a continuation of application Ser. No. 323,323, filed Nov. 20, 1981, and now abandoned.

The first stage of the multi-stage delignification/-bleaching of cellulose pulp is intended to remove the major part of the residual lignin, and provides no marked increase in brightness. It is therefore primarily a delignification. The actual increase in brightness is obtained in the later stages of the treatment, which is therefore a true brightness-increasing bleaching. The initial delignifying and bleaching stages are carried out with chlorine, chlorine dioxide or mixtures thereof as bleaching chemicals, while oxidizing chemicals such as hypochlorite, chlorine dioxide and peroxide are used in the brightness-increasing bleaching stages.

The bleaching of cellulose pulp with bleaching agents containing chlorine increasingly uses chlorine dioxide, and less and less chlorine. This is because chlorine dioxide is less harmful to the environment. This trend, however, has resulted in an increase in the total cost of bleached pulp. The combination of an effluent which is environmentally favorable and low cost cellulose pulp bleaching has long been sought.

In terms of the amount of energy required per unit amount of active chlorine, it is much cheaper to produce chlorine than chlorine dioxide, although chlorine reacts with lignin and the carbohydrate content of the cellulose pulp and gives rise to toxic substances of the type chlorinated hydrocarbons and chlorinated lignin, which are discharged to the atmosphere or environment. Chlorine dioxide reacts solely with the lignin, without appreciable formation of organic chlorine compounds and attack on the cellulose and the hemicellulose. The extent of attack on the carbohydrate content of the cellulose pulp can be reduced by diluting chlorine with chlorine dioxide.

In so-called displacement bleaching, a bleaching chemical, for example, chlorine, is allowed to react with the pulp for a given period of time and then displaced with water or alkali solution. Then, following a given period of time, this liquid is in turn displaced with another bleaching chemical solution, for example, a solution containing chlorine dioxide, which affords the advantage of allowing simplified apparatus to be used.

While all bleaching chemicals have both advantages and disadvantages, it has not been possible to optimally utilize the bleaching chemicals chlorine and chlorine dioxide in such a manner according to known techniques, that the advantages afforded by each are utilized simultaneously while their disadvantages are counteracted.

In accordance with the present invention, optimal utilization of chlorine dioxide and chlorine bleaching chemicals is obtained by first adding a liquid containing chlorine dioxide to the cellulose pulp; then reacting the cellulose pulp with said chlorine dioxide over a selected period of time; and then decreasing the amount of active chlorine available by a substantial amount, optionally to a negligible amount, either by decreasing the amount of liquid accompanying the pulp and/or by displacing the liquid with newly supplied liquid, such liquid containing substantially no active chlorine or at most only a small quantity of active chlorine. The displaced liquor can be replenished with chlorine and optionally with chlorine dioxide, and mainly supplied to fresh cellulose pulp in the same delignifying/bleaching stage and/or to cellulose pulp in another delignifying/bleaching stage.

FIG. 1 is a flow diagram showing a preferred embodiment of the method according to the invention.

The bleaching stage according to the invention can be placed anywhere in a bleaching sequemce, i.e., at the beginning of the sequence, in the middle of the sequence, or at the end of the sequence. It is particularly advantageous to place the bleaching stage according to the invention at those locations where previously chlorine dioxide stages have been used. It is also possible to replace chlorine stages with the bleaching stage according to the invention, for example, as a first bleaching stage in a bleaching sequence.

The method of the invention can be applied to the delignifying and/or bleaching of any cellulose pulp. The term "cellulose pulp" includes cellulosic fibrous material produced from any lognocellulosic material, such as wood, straw, bagasse, flax and cotton. The invention can be applied to advantage to chemical cellulose pulp, i.e., pulp produced by the alkaline pulping or sulfite pulping of lignocellulosic material. Examples of alkaline-digested chemical pulps are sulfate pulp, polysulfide pulp and soda pulp (i.e., pulp which has been digested by means of sodium hydroxide with an optional addition of redox catalysts). The invention can also be applied to pulps having a higher yield than chemical cellulose pulp, for example, semichemical pulp.

The method according to the invention can also be applied to cellulose pulp of varying pulp concentrations. The cellulose pulp fibers, however, must contain water, and preferably be immersed in water. In accordance with a preferred embodiment of the invention, the cellulose pulp is in the form of an aqueous suspension having a pulp concentration within the range from 2% to 40%, suitably from 3% to 37%, preferably from 8% to 35%.

Since the bleaching stage according to the invention can be placed anywhere in a bleaching sequence, the preceding treatment stage can vary. It is normal, however, prior to application of the delignification and bleaching method of the invention to filter out the cellulose pulp fibers in a washing filter, so as to form a coherent pulp web having a pulp concentration of from 11% to 16%. The pulp web is normally disintegrated, for example in a screw, where the web is broken up into fibers and fiber bundles, and steam is supplied in order to heat it to the desired temperature.

The cellulose pulp is then passed to an apparatus in which aqueous chlorine dioxide solution is mixed with the pulp to a pulp concentration within the range from 1.5% to 35%, suitably from 2.5% to 30%, preferably from 6% to 25%. The total amount of active chlorine added to the cellulose pulp is primarily dependent upon the lignin content of the pulp, and can therefore vary considerably. Normally, the amount of active chlorine added to the pulp is from 0.2% to 10% by weight of the absolutely dry pulp.

The apparatus in which chlorine dioxide is mixed with the cellulose pulp is normally referred to as a mixer. Such mixers are of two types, namely, dynamic mixers, containing one or more movable parts, such as a pin mixer, and static mixers, which include no movable parts. The two types of mixers can be used when mixing chlorine dioxide with the cellulose pulp in accordance with the invention.

Subsequent to supplying the liquid containing chlorine dioxide to the cellulose pulp, the pulp is conveyed, normally in tbe form of an aqueous suspension, to a retention vessel, in which bleaching is continued for a period of between 0.1 and 30 minutes, suitably between 0.2 and twenty minutes, preferably from 0.3 to 10 minutes.

The temperature may vary during the bleaching process, and is dependent upon several other parameters, such as time, for example. The temperature is normally within the range from 20° to 90° C., suitably from 30° to 70° C., and preferably from 40° to 60° C.

Liquid containing residual bleaching chemicals is then removed from the cellulose pulp. Removal of such liquid can be effected in different ways. For example, the cellulose pulp, which is normally in the form of an aqueous suspension, can be subjected to a pressing operation, so as to increase the concentration of the pulp. The liquid containing active chlorine may also be removed by displacing it with a freshly-supplied liquid. These two methods may also be used in combination. It is desirable that the amount of active chlorine available to the cellulose pulp be reduced as much as possible, so that the amount becomes negligible.

The separated liquid containing active chlorine is recovered and replenished, primarily with chlorine. The amount of chlorine added to the recovered liquid is within the range from 10 to 35%, suitably from 15 to 30%, preferbly from 22 to 26% of the amount of active chlorine already present in the liquid. In accordance with a preferred embodiment of the invention, the replenished liquid is recycled to newly supplied cellulose pulp in the same bleaching stage, and constitutes the chlorine dioxide-containing liquid charged to the cellulose pulp at the beginning of the bleaching stage.

During the time which passes between the addition of chlorine to the recycled liquid and the charging of the same to the newly supplied cellulose pulp, the chlorine is coverted mainly to chlorine dioxide. In order to ensure that the replenished recycled liquid contains sufficient chlorine dioxide, it is usually necessary to also add a quantity of fresh chlorine dioxide. The fresh chlorine dioxide can be added to the separated liquid prior to the chlorine charge, or together with said chlorine charge, or subsequent thereto.

As is well known, it is difficult to produce totally pure chlorine dioxide. Technical chlorine dioxide normally contains a certain amount of chlorine, and even though the percentage of chlorine present may be as high as 30%, this mixture is included in the term chlorine dioxide. The amount of fresh chlorine dioxide charged is from 10 to 70%, suitably from 20 to 65%, preferably from 40 to 60%, of the total amount of fresh active chlorine charged to the stage.

The separated liquid, which is replenished with chlorine, can also be recovered in other ways. In accordance with one embodiment of the invention, the liquid is divided into two portions, of which one is recycled and supplied to newly charged cellulose pulp in the same bleaching stage, subsequent to supplementing the liquid with fresh chlorine dioxide, and the other portion is passed backwards or forwards in the bleaching sequence to some other chlorine dioxide stage, or to a further bleaching stage in which bleaching chemicals containing chlorine are used. These bleaching stages may be conventional stages, or stages in accordance with the invention.

It is also possible to pass all of the separated liquid replenished with chlorine backwards or forwards in the bleaching sequence to some other chlorine dioxide stage, or to a further bleaching stage in which bleaching chemicals containing chlorine are used. In this case, fresh chlorine dioxide must constantly be charged to the cellulose pulp at the beginning of the initial bleaching stage. If the separated liquid replenished with chlorine is passed forward in the bleaching sequence, i.e., to a downstream bleaching stage, it is not always necessary to add fresh chlorine dioxide to the liquid, since at this position in the bleaching sequence the cellulose pulp has a lower lignin content than in the original stage, i.e., the stage from which the separated liquid originates. If the separated liquid replenished with chlorine is moved backward in the bleaching sequence, i.e., to an upstream or earlier bleaching stage, the reverse is true, i.e., the high lignin content of the cellulose pulp in this position of the bleaching sequence requires the separated liquid to be replenished with chlorine dioxide.

As will be understood, it is also possible to divide the separated liquid into two portions subsequent to replenishing the separated liquid with both chlorine and chlorine dioxide. It is also possible to pass a larger or smaller part of the separated liquid, subsequent to replenishing the same with chlorine and optionally also with chlorine dioxide, to a bleaching stage which is separate from the original bleaching stage, and to other unit operations or for other uses, for example, for the treatment of effluents.

As previously mentioned, the liquid can be removed from the cellulose pulp in several ways. If a press is used to remove said liquid, the cellulose pulp will still contain a significant quantity of active chlorine, and, in order to maintain good bleaching economy, it is necessary to allow the cellulose pulp to react with residual active chlorine in a further stage. The volume of the retention vessel should be such as to permit the reaction to continue for a period of from 0.1 to 60 minutes, suitably from 0.2 to 45 minutes, preferably from 0.3 to 30 minutes. After this interval or dwell time, the residual content, if any, of active chlorine will be very low. The cellulose pulp is then passed to a washing stage or to a further treatment stage. This is a preferred embodiment of the invention.

In accordance with another embodiment of the invention, practically all active chlorine is removed from the cellulose pulp. This can be effected, for example, by displacing from the cellulose pulp practically all the liquid accompanying said pulp, with the aid of newly-supplied liquid. This liquid may be pure water, slightly contaminated water from another kind of bleaching stage within the cellulose pulp manufacturing process, or a bleaching waste liquor containing only a small quantity of residual bleaching agent.

In accordance with still a further embodiment of the invention, the liquid used to displace the accompanying liquid contains alkali, such as sodium hydroxide. This means that practically all active chlorine is removed from the cellulose pulp, and that the pulp is then subjected to alkali extraction. This treatment process is comparable with a conventional alkali stage, and can be carried out in apparatus normally used in such a stage.

Subsequent to being subjected to the described treatment process, the cellulose pulp treated in accordance with the above embodiments of the invention can also be passed to a washing stage, or to some other treatment stage.

It is important that the pH of the liquid accompanying the cellulose pulp, the removed liquid and the recycled liquid be controlled and adjusted so as to lie within the range from 4 to 6, suitably from 4.5 to 5.5, and preferably from 4.75 to 5.25.

A number of advantages are obtained when bleaching cellulose pulp in accordance with the invention.

A large part of the chlorine dioxide previously used when bleaching in different bleaching sequences can be replaced with the less expensive bleaching chemical chlorine, without the amount of organically bound chlorine (i.e., the most toxic substance), increasing in the bleaching waste liquor. This means that the relationship between the use of chlorine and sodium hydroxide in the bleaching sequence can be maintained in an efficient manner, this relationship being important from the aspect of economy. If the amount of chlorine used is excessively low, the amount of sodium hydroxide produced will also be too low in relation to demand within the cellulose industry, which in turn results in higher total production costs for bleached cellulose pulp.

The amount of chlorine dioxide charged to the system is utilized more efficiently, probably because decomposition or degradation of $HClO_2$ to HClO and $HClO_3$ is counteracted by the addition of chlorine in accordance with the invention. The treatment temperature can be lowered, and the time shortened, compared with conventional chlorine dioxide bleaching, because of the high efficiency (high reaction rate) of the bleaching method according to the invention. This lowering of the temperature results in the saving of energy, while the shorter treatment time means that smaller retention volumes, for example in the form of bleaching towers, may be provided, which reduces investment and operational costs.

The following Examples represent preferred embodiments of the method according to the invention:

EXAMPLE 1

Birch sulfate pulp having a Kappa number of 2.7 and a viscosity of 1179 $dm^3/kg$ was bleached in a Control with chlorine dioxide in accordance with conventional technique, and in Example 1 with chlorine dioxide in accordance with the invention.

When bleaching in accordance with the Control, 334 g of a 12% aqueous pulp suspension was placed in a bleaching vessel, and 116 g of water added. The temperature of the mixture was adjusted to 42° C in a water bath. Aqueous chlorine dioxide solution, 50.2 ml having a strength of 13 g active chlorine/liter was added. The chlorine dioxide solution was admixed with the pulp by mechanical shaking over a period of two minutes, calculated from the time when the chlorine dioxide was added. The bleaching vessel was thereafter kept in the water bath for thirty minutes. The bleaching was then interrupted and the pH and residual chlorine content of the pulp suspension determined. The cellulose pulp was then washed with distilled water, and its brightness and viscosity determined.

In Example 1, in accordance with the invention, 334 g of a 12% aqueous cellulose pulp suspension was placed in a bleaching vessel, and 89.2 g of water added. The temperature of the mixture was adjusted to 42° C. in a water bath. NaOH in an amount of 0.1 g was added to the pulp suspension, in order to slightly raise its pH. While mechanically agitating the pulp suspension, 76.9 ml of aqueous chlorine dioxide solution having a strength of 13 g active chlorine/liter was added. The time measurement was commenced at the point of adding chlorine dioxide. After five minutes had passed, 367 ml of liquid were pressed from the pulp suspension. This liquid contained a certain amount of residual active chlorine. The pH and residual chlorine content of the liquid were determined. The bleaching vessel containing cellulose pulp at elevated pulp concentration was held for a further 25 minutes at 42° C. Residual active chlorine was permitted to react with the cellulose pulp during this time. The bleaching process was then interrupted, and the pH and residual chlorine content of the pulp suspension determined. The brightness and viscosity of the cellulose pulp were determined subsequent to washing said pulp with distilled water.

Conditions and results are set forth in Table I.

TABLE I

| | Control | Example 1 |
|---|---|---|
| Pulp concentraion, % | 8 | |
| Before pressing | | 8 |
| After pressing | | 30 |
| Temperature °C. | 42 | 42 |
| Time, minutes | 30 | |
| Before pressing | | 5 |
| After pressing | | 25 |
| Charge active chlorine, % | 1.63 | 2.50 |
| Residual active chlorine before pressing, % | | 1.90 |
| Active chlorine pressed out, % | | 1.52 |
| Active chlorine accompanying the pulp to the second stage, % | | 0.38 |
| pH of the liquid pressed out | | 5.25 |
| Final pH | 3.3 | 4.90 |
| Residual active chlorine, % | 0.97 | 0.08 |
| Brightness, % ISO | 69.1 | 79.5 |
| Viscosity, $dm^3/kg$ | 1195 | 1130 |

The bleaching chemicals charged and the residual chlorine content were calculated in percent by weight of the absolutely dry pulp. Brightness was determined in accordance with SCAN-C11:75, and viscosity according to SCAN-C15:62.

As seen from the Table, the bleaching method according to the invention is more effective than conventional chlorine dioxide bleaching, which is evidenced in the much higher brightness of the cellulose pulp, and the much lower residual chlorine content of the pulp suspension, under similar conditions of temperature and total bleaching time.

Despite the great difference in brightness of the pulp according to the Control and the pulp of Example 1 according to the invention, the viscosity of the pulp according to the invention is only insignificantly lower than the viscosity of the Control pulp.

This Example is intended to exemplify the embodiment of the invention in which fresh chlorine dioxide is constantly charged to the original bleaching stage, while the withdrawn bleaching liquor containing active chlorine is used in another bleaching stage or for other purposes, for example, for treating effluents.

In this case, the liquid pressed out and containing 1.52% active chlorine was used as a starting bleaching liquor in Example 2.

EXAMPLE 2

Birch sulfate pulp similar to that used in Example 1 was used in this Example 2 according to the invention, i.e., a birch sulfate pulp having a Kappa number of 2.7, and a viscosity of 1179 $dm^3/kg$.

As previously mentioned, bleaching liquor pressed from the pulp in Example 1 was used as a starting bleaching liquor. This bleaching liquor was replenished with both chlorine and chlorine dioxide.

334 g of 12% aqueous cellulose pulp suspension were placed in a bleaching vessel, and 411 ml of a bleaching solution having a strength of 2.43 g acitive chlorine/-liter and 0.1 g NaOH was added to the pulp suspension. The bleaching solution was obtained by mixing 367 ml liquor pressed from the pulp in Example 1 with 25.3 ml of aqueous chlorine solution having a strength of 6 g active chlorine/liter and 18.5 ml of a chlorine dioxide solution having a strength of 13 g active chlorine/liter. The time measurement was commenced from the point of adding the bleaching solution to the cellulose pulp.

After five minutes, 561 ml of liquid were pressed from the cellulose pulp. The pH and the residual chlorine content of the liquid pressed from the pulp were then determined.

The bleaching vessel containing cellulose pulp of elevated pulp concentration was held for a further 25 minutes at 42° C. Residual active chlorine was allowed to react with the cellulose pulp during this time period.

The bleaching process was then interrupted and the pH and residual chlorine content of the pulp suspension determined. The brightness and viscosity of the cellulose pulp were determined after washing the pulp with distilled water. The conditions and results are set forth in Table II with regard to the tests made in accordance with the invention in both Example 1 and this Example 2.

TABLE II

| | Example 1 | Example 2 |
|---|---|---|
| Pulp concentration, % | | |
| Before pressing | 8 | 5.4 |
| After pressing | 30 | 22.2 |
| Temperature, °C. | 42 | 42 |
| Time, minutes | | |
| Before pressing | 5 | 5 |
| After pressing | 25 | 25 |
| Charge active chlorine, % | 2.50 | 2.50 |
| Residual active chlorine before pressing, % | 1.90 | 1.85 |
| Active chlorine pressed out, % | 1.52 | 1.48 |
| Active chlorine accompanying the pulp to the second stage, % | 0.38 | 0.37 |
| pH of the liquid pressed out | 5.25 | 5.10 |
| Final pH | 4.90 | 4.70 |
| Residual active chlorine, % | 0.08 | 0.03 |
| Brightness, % ISO | 79.5 | 78.5 |
| Viscosity, $dm^3/kg$ | 1130 | 1115 |
| Organically bound chlorine in the bleaching waste liquor mg/kg organic material | 25 | 27 |

The bleaching chemical charge and the residual chlorine content are calculated in percent by weight of absolutely dry pulp. Brightness is determined in accordance with SCAN-C11:75, and viscosity according to SCAN-C15:62. The amount of organically bound chlorine in the bleaching waste liquor was determined after extraction with petroleum ether.

As will be seen from the above Table, the two pulps had equal brightness. The difference with respect to viscosity was only marginal.

As previously mentioned, the two tests differed in that fresh chlorine dioxide was charged to the cellulose pulp in Example 1, while in Example 2 bleaching liquor pressed from the pulp in Example 1 and fortified with fresh chlorine and fresh chlorine dioxide was used. Example 2 illustrates that a large part of the fresh active chlorine supplied may be chlorine. In this Example, 39% chlorine of the totally supplied fresh active chlorine was supplied. This illustrates that a high percentage of the expensive bleaching chemical chlorine dioxide can be replaced by the less expensive bleaching chemical chlorine when practising the method according to the invention, without impairing the quality or properties of the pulp, and without appreciably increasing the amount of chlorine organically bound in the bleaching waste liquor.

EXAMPLE 3

In this Example, experimental equipment in a manufacturing plant in accordance with the flow diagram illustrated in FIG. 1 was used in the method according to the invention.

In this Example, a spruce sulfite pulp having a Kappa number of 8.0 and a viscosity of 1115 $dm^3/kg$ was used. A portion of the pulp was also bleached in a conventional chlorine dioxide stage for comparison purposes, as a Control.

In the Control, the pulp concentration of the aqueous pulp suspension was 8%, the temperature 60° C., and the time 180 minutes. The chlorine dioxide charged was 2.2% active chlorine, by weight of the absolutely dry pulp. At the termination of the bleaching process, the pH of the pulp suspension was 2.9 and the residual active chlorine 0.05%, by weight of the absolutely dry pulp.

In Example 3, according to the invention, an aqueous suspension of the same pulp having a concentration of 16% was passed through a supply line 1 to a mixer 2. The cellulose pulp was mixed in the mixer 2 with an aqueous solution of chlorine dioxide, which was passed to the mixer through a line 3. The amount of chlorine dioxide charged was 3.79% active chlorine by weight of the absolutely dry pulp. In this way, the pulp concentration was lowered to 3.3%. The pulp suspension was then conveyed through a retention vessel 4, so constructed as to provide a retention time of two minutes. The pulp suspension then passed to an apparatus 5, in which liquid was pressed from the pulp suspension and removed through line 6. The concentration of the pulp was raised in this way to 15.1%. The pulp suspension was then passed to a bleaching tower 7, in which the cellulose pulp was permitted to react with residual active chlorine over a period of thirty minutes and at a temperature of 60° C. Subsequent to passing the bleaching tower 7, the bleaching process was interrupted by conveying the pulp suspension to a washing filter (not shown). At the end of the bleaching process, the pH of the pulp suspension was 4.8, and its content of residual active chlorine 0.03%, by weight of the absolutely dry pulp.

The liquid pressed from the pulp was passed to a mixing vessel 8 through a line 6. Chlorine gas corresponding to 0.44% active chlorine was supplied to said liquid through a line 9. The replenished liquid was passed through a line 10 to a second mixing vessel 11. Aqueous chlorine dioxide having a strength of 23.2 g active chlorine/liter was supplied to the liquid through a line 12. The chlorine dioxide solution contained a minor quantity of chlorine. Chlorine dioxide corresponding to 1.16% active chlorine and chlorine corresponding to 0.04% active chlorine were charged through a line 12. This liquid comprised the aqueous solution of chlorine dioxide which, in accordance with that previously mentioned, was supplied to the pulp suspension through line 3.

The brightness and viscosity of the washed pulps produced in accordance with the Control and Example 3 in accordance with the invention was determined. The data obtained and the chemical consumption are set forth in Table III.

TABLE III

| | Control | Example 3 |
|---|---|---|
| Brightness, % ISO | 78.5 | 78.3 |
| Viscosity, $dm^3/kg$ | 1045 | 1060 |
| Chlorine dioxide consumption, % active chlorine | 2.2 | 1.20 |
| Chlorine consumption, % | — | 0.44 |

The above results show that the brightness and viscosity of the two pulps were equivalent, despite the fact that the bleaching chemical consumption in Example 3 was much lower than the consumption in the Control. Moreover, the bleaching time in the method according to the invention is much shorter than that in the Control. This means that the bleaching process according to the invention is much more economical than a conventional chlorine dioxide bleaching stage.

EXAMPLE 4

In this Example, the method according to the invention was carried out with a pine sulfate pulp using the factory experimental equipment in the flow diagram illustrated in FIG. 1.

The pulp had a Kappa number of 3.0 and a viscosity of 995 $dm^3/kg$. Pulp from a similar batch was also bleached in a conventional chlorine dioxide stage for comparison purposes, as a Control.

In the Control, the pulp concentration of the aqueous pulp suspension was 8%, the temperature 60° C., and the time 180 minutes. The amount of chlorine dioxide charged was 1.6% active chlorine, by weight of the absolutely dry pulp. At the end of the bleaching stage the pulp suspension had a pH of 2.9 and a residual active chlorine content of 0.08% by weight of the absolutely dry pulp.

In Example 4, according to the invention, the aqueous pulp suspension having a pulp concentration of 16% was passed through the line 1 to the mixer 2. The cellulose pulp was mixed in the mixer 2 with an aqueous solution of chlorine dioxide, which was passed to the mixer through the line 3. The amount of chlorine dioxide charged was 2.7% active chlorine, by weight of the absolutely dry pulp. In this way the concentration of the pulp was lowered to 8%. The pulp suspension was then conveyed through a retention vessel 4 of such construction as to provide a retention time of thirty minutes. The temperature was 60° C.

The pulp suspension then passed to the apparatus 5, in which liquid was removed from said suspension by displacement on a pressure filter with washing liquid, which was supplied through the line 13. In this way, practically all active chlorine was removed through the line 6, which brought the bleaching process to an end. At the end of the bleaching process, the pH of the pulp suspension was 5.1. The amount of active chlorine in the displaced liquid in line 6 was 1.62%.

The displaced liquid was passed to the mixing vessel 8 through the line 6. Chlorine gas corresponding to 0.41% active chlorine was supplied to said liquid through the line 9. 91% of the displaced liquid was passed to the mixing vessel 11 through the line 10. Aqueous chlorine dioxide solution having a strength of 15 g of active chlorine/liter was supplied to the liquid through the line 12. Thus, through the line 12 there was charged to the system chlorine dioxide corresponding to 0.85%. The resultant aqueous solution of chlorine dioxide was supplied to the pulp suspension in accordance with the aforesaid through the line 3.

The brightness and viscosity of the washed pulps produced in accordance with the Control and Example 4 were determined. The data obtained and the chemical consumption are set forth in Table IV.

TABLE IV

| | Control | Example 4 |
|---|---|---|
| Brightness, % ISO | 80.2 | 79.5 |
| Viscosity, $dm^3/kg$ | 945 | 960 |
| Chlorine dioxide consumption, % active chlorine | 1.52 | 0.85 |
| Chlorine consumption, % | — | 0.41 |
| Active chlorine recycled (through lines 14 and 15) % | — | 0.18 |

The above results show that the brightness and viscosity of the pulps were equal, despite the fact that the bleaching chemical consumption is much lower in the method according to the invention, Example 4, than in the Control.

As mentioned above, 91% of the bleaching liquor present in the mixing vessel 8 was passed to the mixing vessel 11 through the line 10 and from said vessel back to the initial bleaching stage through the line 3. The residual amount of bleaching liquor (9%) was passed via lines 14 and 15 to a conventional chlorine dioxide stage further forward in the bleaching sequence (not shown), and there constituted part of the bleaching liquor charged. Because of this, the amount of bleaching liquor originally supplied to the cellulose pulp was utilized to the full. From an economic aspect, this means that bleaching cellulose pulp in accordance with the invention is much superior to bleaching cellulose pulp in accordance with a conventional chlorine dioxide stage.

The above Examples show part of the replenished, separated bleaching liquor being utilized in a bleaching stage located further downstream in the bleaching sequence. By conveying this liquor via lines 14 and 16, this liquor also can be utilized in a bleaching stage located earlier, or upstream, in the bleaching sequence. By conveying the liquor via lines 14 and 17, said liquor can be utilized in another unit operation or bleaching stage, or, for example, for treatment of waste or effluent liquor.

The bleaching of cellulose pulp obtained for example by the sulfate or sulfite process is a multi-stage procedure, and usually includes as separate steps in any of a larger number of sequences of one or more of each, (a) a chlorination stage,
(b) an alkali treatment or alkali extraction stage,
(c) a hypochlorite treatment stage, and
(d) a chlorine dioxide treatment stage.

These treatments can be carried out in almost any order, and two or more of such stages are frequently included, but usually not in succession, but interleaved with one or more of the other stages.

In general, sulfate pulps require more treatment stages for complete bleaching than sulfite pulps. Also, in the case of sulfate pulps, chlorination, alkali treatment and chlorine dioxide treatment are almost always necessary while the hypochlorite treatment can sometimes be omitted, whereas in the case of sulfite pulps, either the hypochlorite or the chlorine dioxide treatments can be omitted, and the bleaching can be reduced to as little as three or four stages. However, most of the multistage bleaching processes employ a chlorination stage and an alkali treatment stage, and the reason is that these stages are required for delignification. Some sulfate pulps are more difficult to delignify than others, and in the case of these pulps, one chlorination stage may be insufficient to delignify the pulp sufficiently. Hence, a complementary delignification stage can be carried out in an additional chlorination stage, or in a hypochlorite treatment stage, or in a chlorine dioxide treatment stage.

The conditions under which the various treatment stages are carried out in conventional bleaching processes are summarized in Table A, which follows:

TABLE A

| Stage | Treatment | Pulp Consistency | Temperature (°C.) | Time (Hours) | Amount |
|---|---|---|---|---|---|
| C | Chlorination ($Cl_2$ or $ClO_2$ or both) | 1–4% | 5–25° C. | ⅓–2 hours | Enough $Cl_2$ or $ClO_2$ to provide at end of treatment 0.1 to 0.5% excess $Cl_2$ based on pulp weight |
| E | Alkali extraction (NaOH) | 4–18% | 25–80° C. (up to 130° C. in hot alkali refining) | several minutes to 4–5 hours | Enough NaOH to give a pH 8–12.5 at end of treatment |
| H | Hypochlorite [(Na OCl) or $Ca(OCl)_2$] excess alkali (NaOH) | 4–18% | 25–60° C. | 1–4 hours | From 0.2 to 3% $Cl_2$ to provide at end of treatment a 0.1% $Cl_2$ excess, based on pulp weight, and alkali (normally between 10 and 100% of chlorine amount) to give a pH >8.5, usually 10–11 |
| D | Chlorine dioxide ($ClO_2$) | 4–15% | 50–90° C. | 2–5 hours | Enough to provide 0.5 to 5% $Cl_2$, based on pulp weight, with an excess of from 0.1 to 0.5% $Cl_2$ at end of treatment |

Bleaching includes the chemical steps of decomposing the lignin by oxidation and converting it into a water-soluble or alkali-soluble form.

Chlorine is considered to be the most effective and least expensive of the delignifying agents that are available. However, it has a tendency to decompose the cellulose, and the lignin that is not removed is discolored. Therefore, it is necessary to keep the amount of chlorine at the minimum that will give effective delignification, while chlorine alone is not sufficient, and bleaching must be carried to completion using hypochlorite and/or chlorine dioxide.

Chlorination thus is usually carried out in such a manner that there is a small excess of chlorine present at the conclusion of the chlorination. This excess is rather important to control. If there is too high an excess remaining, then the tendency of the chlorination stage to decompose cellulose is increased, and if there is no excess, or if the excess is too small, the delignification of the cellulose is incomplete. If the chlorination must be applied in two stages, the risk of decomposition of the cellulose is increased in the second stage, and therefore the arrangement of the treatment stages is usually such that the chlorination is restricted to one stage, and a substitute hypochlorite or chlorine dioxide stage is used instead, if possible.

The chlorination, stage C, is normally performed with a relatively low pulp consistency, from about 1 to about 4%, and at low temperatures, from about 5° to about 25° C., for short treatment times, from about ⅓ to about 2 hours. The quantity of chlorine used varies with the properties of the unbleached pulp, but is sufficient only to give an excess within the range from about 0.1 to about 0.5% chlorine, based on the weight of the dry pulp, at the conclusion of the treatment.

Chlorine dioxide can also be used in place of chlorine in the chlorination stage. In this event, the amount of chlorine dioxide used is sufficient to supply an amount of chlorine within the range set out above sufficient to ensure an excess of from 0.01 to 0.5% chlorine at the end of the treatment.

The alkali extraction, stage E, is designed to remove the lignins that have been made alkali-soluble in the chlorination stage, and is carried out at a relatively high pulp consistency. This is normally at from about 4 to about 18%; when using presses for dewatering, up to 30%. The temperature can be rather low, from 25° to 30° C., but in the so-called hot alkali refining processes, for producing pulp with a high alpha cellulose content, temperatures of up to 130° C. can be employed. The treatment time can be very short, for just several minutes, up to form four to five hours. The amount of alkali charged to the system varies according to the properties of the pulp which it is desired to produce. In the case of paper pulps, it is usually carried out in such a manner that the pH at the conclusion of the treatment is within the range from about 8 to about 12.5, generally about 11.

The hypochlorite treatment, stage H, is also carried out at relatively high pulp consistencies, normally from about 4 to about 18%. The temperatures are usually rather higher than in either the chlorination or the alkali treatment, and range from about 25 to about 60° C. The treatment time is also somewhat longer, from one hour and upwards, normally from two to four hours. The quantity of hypochlorite charged to the system varies with the type of pulp and the conditions, and is based on the amount of chlorine provided. The amount can range from very small amounts, of the order of 0.2% $Cl_2$ by weight of the pulp, to 3% $Cl_2$, based on the weight of dry pulp. This treatment is also carried out in a manner to ensure that a small excess of chlorine remains at the conclusion of the treatment, about 0.1% by weight of the pulp.

Hypochlorite having a pH at about and immediately below the neutral point of 7 strongly decomposes cellulose, and consequently an amount of alkali is also charged to the system to provide a surplus of alkali, and maintain the pH well above 7. The amount of alkali charged as NaOH can be within the range from about 10 to about 100% by weight of the chlorine charged to the system in this stage, so as to ensure that at the conclusion of the hypochlorite treatment the pH is above 8.5, and is normally within the range from 10 to 11.

The chlorine dioxide treatment is carried out with the same pulp consistency as the hypochlorite treatment, although in practice a somewhat lower consistency can be used, since the chlorine dioxide is obtained in a more dilute form than the hypochlorite solution. Thus, the pulp consistency during chlorine dioxide treatment can be within the range from about 4 to about 15%. The temperature is higher, within the range from about 50° to about 90° C., and normally about 70° C. The treatment time is at least two hours, and can be from three to five hours.

The quantity of chlorine dioxide charged to the system is based on the amount of chlorine equivalent to the chlorine dioxide within the range from about 0.5 to about 3% $Cl_2$, based on the weight of the dry pulp, and sometimes even more than 3%, up to about 5%. This treatment is also carried out in a manner to ensure a small excess, about 0.1% to 0.5% $Cl_2$, at the end of the treatment.

The usual bleaching process for sulfate pulps includes six stages, in the order C E H D E D, the letters corresponding to the treatment stages set out above. An alkali extraction normally follows one or more stages of delignification, to remove solubilized lignins and other extractives. These stages can also be arranged in other combinations, for example,

C E C E H D E D
C E H C H D E D
C H E D E D
C E D E D

Sulfite pulps can be bleached with shorter bleaching sequences, and illustrative sequences include

C E C E D
C E H D
C E D H
C E H H
C E H

It will be noted that in all of the sequences in common use for sulfate and sulfite pulps, the first treatment stage is usually a chlorination stage, and the second treatment stage is usually an alkali or extraction stage, to remove the lignins and other alkali-soluble extractives. In the single exception noted above, the hypochlorite stage serves as a substitute second chlorination stage, seeking to reduce the risk of cellulose decomposition in the first chlorination stage. Anyhow as pointed out above also this hypochlorite stage comprises an alkali treatment immediately following the chlorination. An alkali extraction is interposed wherever more alkali-soluble extractives are to be removed.

The chlorine-chlorine dioxide treatment and/or the final alkali extraction stage to dissolve chlorinated lignin can be followed by one or more hypochlorite (H) and/or chlorine dioxide (D) bleaching stages, interleaved with alkaline extraction stages (E), under conventional conditions, as shown in Table A.

An alkali extraction stage is interposed following the chlorine-chlorine dioxide treatment stage of the invention to remove the alkali soluble lignin derivatives and other alkali-soluble extractives formed in that stage. This alkali extraction can directly follow the $Cl_2$—$ClO_2$ treatment, or be interposed at a later stage.

The alkali extraction can be under the usual conditions, as shown in Table A. However, lower alkali concentrations can be used, since a large proportion of alkali-soluble extractives will have been removed in the first oxygen-alkali treatment, in which some extraction also takes place. Thus, the amount of alkali can be from 0.5 to 1.5%, and at such amounts the pH will be from 8 to 12.5 at the end of the extraction, as in the usual alkali extraction stage.

The pulp consistency in this stage is within the usual range from about 4 to about 18%, the temperature within the usual range from about 25° to about 30° C., up to about 130° C. in a hot alkali refining stage, and the treatment time can range from several minutes to about five hours.

At the conclusion of the alkali extraction stage of the invention, the resulting pulp is more delignified, and has a better quality. The bleaching of the delignified pulp has been performed with less chemical consumption, and results in better quality of the final bleached pulp. Quality of the final bleached pulp is evaluated by the usual criteria: (1) brightness, % SCAN before and after aging at elevated temperatures, (2) viscosity (which is determined for an aqueous copper ethylene diamine solution of the pulp according to SCAN C15:62, and which is a measurement of the mean polymerization degree of the cellulose, i.e., the chain length of the cellulose molecules). The higher the viscosity, and the greater the strength of the pulp, the greater the extent of delignification.

Having regard to the foregoing disclosure, the following is claimed as the inventive and patentable embodiments thereof:

1. A method for delignifying or bleaching cellulose pulp which comprises in at least one stage adding a liquid containing chlorine dioxide to the cellulose pulp; reacting the cellulose pulp with the chlorine dioxide over a selected period of time; and then decreasing the amount of active chlorine available to the pulp by removing at least a substantial amount of the chlorine by removing a portion of the liquid accompanying the pulp; replenishing active chlorine as chlorine dioxide in the liquid removed from the pulp by regenerating chlorine dioxide in situ by adding chlorine as chlorine only in an amount from 10 to 35% of the amount of active chlorine already present in the liquid; and then recyling the replenished liquid as chlorine dioxide liquor to newly supplied cellulose pulp for delignifying or bleaching the pulp.

2. A method according to claim 1 in which the liquid is removed by displacing the liquid with liquid containing substantially no active chlorine.

3. A method according to claim 2 in which in addition to regenerating chlorine dioxide in situ the fresh liquid is also replenished with chlorine dioxide.

4. A method according to claim 1 in which the cellulose pulp prior to the commencement of the delignification or bleaching is at a pulp concentration within the range from 2 to 40%, and the pulp concentration is lowered to within the range from 5 to 30%, by supplying the liquid containing chlorine dioxide.

5. A method according to claim 1 in which the selected time period before decreasing the amount of active chlorine available to the cellulose pulp is within the range from 0.1 to 30 minutes.

6. A method according to claim 1 in which the liquid replenished with chlorine is recycled to newly supplied cellulose pulp in the same bleaching stage.

7. A method according to claim 1 in which the pH of the liquid throughout the process is maintained within the range from 4 to 6.

8. A method according to claim 1 in which after the liquid accompanying the pulp is removed and the amount of active chlorine available to the cellulose pulp is reduced, the cellulose pulp is caused to continue to react with the residual active chlorine-containing liquid in a second stage.

9. A method according to claim 8, in which the cellulose pulp is caused to react with the residual active chlorine-containing liquid over a period of from 0.1 to 60 minutes.

* * * * *